US006543680B1

(12) United States Patent
McCormack

(10) Patent No.: US 6,543,680 B1
(45) Date of Patent: Apr. 8, 2003

(54) MAILBOX EXTENSION MOUNT

(76) Inventor: Robert D. McCormack, 4540 Danbi Rd., Metamora, MI (US) 48455

( * ) Notice: Subject to any disclaimer, the term of this patent is extended or adjusted under 35 U.S.C. 154(b) by 0 days.

(21) Appl. No.: 10/012,621

(22) Filed: Oct. 30, 2001

(51) Int. Cl.[7] ..... B65D 91/00
(52) U.S. Cl. ..... 232/39; 248/128
(58) Field of Search ..... 232/39, 17; 248/128, 248/145.6, 424, 429

(56) References Cited

U.S. PATENT DOCUMENTS

| | | | | |
|---|---|---|---|---|
| 741,489 | A | | 10/1903 | Hamilton et al. |
| 1,139,491 | A | | 5/1915 | Coon |
| 1,471,899 | A | | 10/1923 | Koenig |
| 1,731,682 | A | * | 10/1929 | Pendergrass ..... 248/128 |
| 1,879,200 | A | | 9/1932 | Grimm |
| 1,992,640 | A | | 2/1935 | Steeen |
| 2,723,098 | A | * | 11/1955 | Moore ..... 248/128 |
| 2,781,964 | A | | 2/1957 | Ledgerwood |
| 2,868,444 | A | | 1/1959 | Whittier |
| 3,058,710 | A | * | 10/1962 | Ryan ..... 248/124.1 |
| 3,163,356 | A | | 12/1964 | Joehnk |
| 3,289,988 | A | * | 12/1966 | McKenney et al. ..... 248/145 |
| 3,465,594 | A | * | 9/1969 | Block ..... 248/130 |
| 3,497,078 | A | * | 2/1970 | Nash ..... 211/79 |
| 3,580,491 | A | | 5/1971 | Campbell et al. |
| 3,606,140 | A | | 9/1971 | Shannahan |
| 3,827,626 | A | | 8/1974 | Daigle |
| 4,113,213 | A | | 9/1978 | Gay et al. |
| 4,120,446 | A | | 10/1978 | Fuemmeler |
| 4,121,758 | A | | 10/1978 | Bonner |
| 4,160,520 | A | | 7/1979 | Cluthe |
| 4,403,730 | A | | 9/1983 | Batson |
| 4,496,123 | A | * | 1/1985 | Laramie ..... 248/121 |
| 4,509,675 | A | | 4/1985 | Siff et al. |
| 4,714,192 | A | | 12/1987 | Harlow, Jr. |
| 4,821,953 | A | | 4/1989 | Deciutiis |
| 4,869,426 | A | | 9/1989 | Powers et al. |
| 4,932,587 | A | | 6/1990 | Robbins |
| 4,995,576 | A | * | 2/1991 | Kieswetter ..... 248/145 |
| 5,060,900 | A | * | 10/1991 | Kokoruda et al. ..... 232/39 |
| 5,065,975 | A | | 11/1991 | Giles |
| 5,351,883 | A | | 10/1994 | Pachl |
| 5,971,267 | A | | 10/1999 | Beckmann |
| 6,161,756 | A | | 12/2000 | Upton |

* cited by examiner

*Primary Examiner*—William L. Miller
(74) *Attorney, Agent, or Firm*—Young & Basile P.C.

(57) ABSTRACT

A slide mount for a rural mailbox comprises a plastic base defining multiple, fixed, horizontal slideways and a slide member slidably and complementally assembled to the base. The slide member is sized and shaped to receive the mailbox thereover and to be secured to the mailbox by screws. A handle is attached to the front of the slide member, and a one-way stop prevents the slide member from being fully removed from the base member.

3 Claims, 4 Drawing Sheets

MAILBOX EXTENSION MOUNT

FIELD OF THE INVENTION

The invention described herein is related to the field of post-mounted mailboxes, and more specifically, to a mailbox mounting apparatus which permits a mailbox to be manually extended from the post toward the roadway adjacent the mounting post.

BACKGROUND OF THE INVENTION

In rural areas, mailboxes are usually mounted on posts adjacent a roadway to allow a mail carrier to deliver mail from an automobile without having to exit the vehicle. A rural mailbox typically has a standardized design generally comprising an elongated metal box with a semi-cylindrical top and a hinged door at one end. The base of the box is recessed to create a skirt around the bottom perimeter of the box with screw holes for fastening the box to a support stand.

In the winter, roadway snow plowing frequently creates a snow buildup along the side of the road, making it difficult to gain access to the mailbox to either insert mail into or retrieve mail from the box. In this situation, it is desirable to be able to temporarily extend the mailbox closer to the roadway in order to facilitate ready access to the interior of the box by the mail carrier who may not deliver the mail if the box is not readily accessible. There are many examples in the prior art of devices intended to permit a post-mounted rural mailbox to be extended forwardly; i.e., toward the roadway from the post mount. However, the prior art devices tend to be mechanically complicated, subject to rust and corrosion, are incompatible with standard mailboxes and/or are difficult to assemble.

SUMMARY OF THE INVENTION

It is an object of this invention to provide a slide mount for a rural mailbox which is easy to operate, rustproof, stable, simple to assemble and compatible with a conventional mailbox.

To that end, my invention is an improved, slidable mount for a conventional rural mailbox with a recessed bottom and an edge skirt. It comprises a molded plastic base member which is attachable to or integral with a ground post, and which provides a plurality of fixed, parallel, horizontal slideways. My invention further comprises a molded plastic, movable slide member having opposite side surfaces and a plurality of parallel slide elements which interlockingly and complementally fit into and around the slideways of the base member in a tongue and groove fashion such that the opposite side surfaces lie to the outside of the interlocking assembly. The shapes of the slideways and elements is such as to prevent disassembly of the slide member from the base other than by sliding movement. Further, my slide member is sized and shaped to conform essentially to the cavity on the underside of the mailbox so as to allow the edge skirt to fit snugly over the side surfaces of the movable slide member. Screws or the like can be inserted through the skirt and into the movable slide member to attach the mailbox thereto.

In the preferred embodiment hereinafter described in greater detail, I further provide a unidirectional stop between the base and slide member which permits the slide member to be complementally inserted into the base member for assembly purposes, but which prevents removal of the slide member from the base member, and also provides a mechanical stop as the slide member is retracted from the base member. In my preferred embodiment, I also place a handle on the forward, outside edge of the slide member to assist the user in sliding the mailbox out and back along the slide axis.

DESCRIPTION OF THE ILLUSTRATED EMBODIMENT

Figure 1:
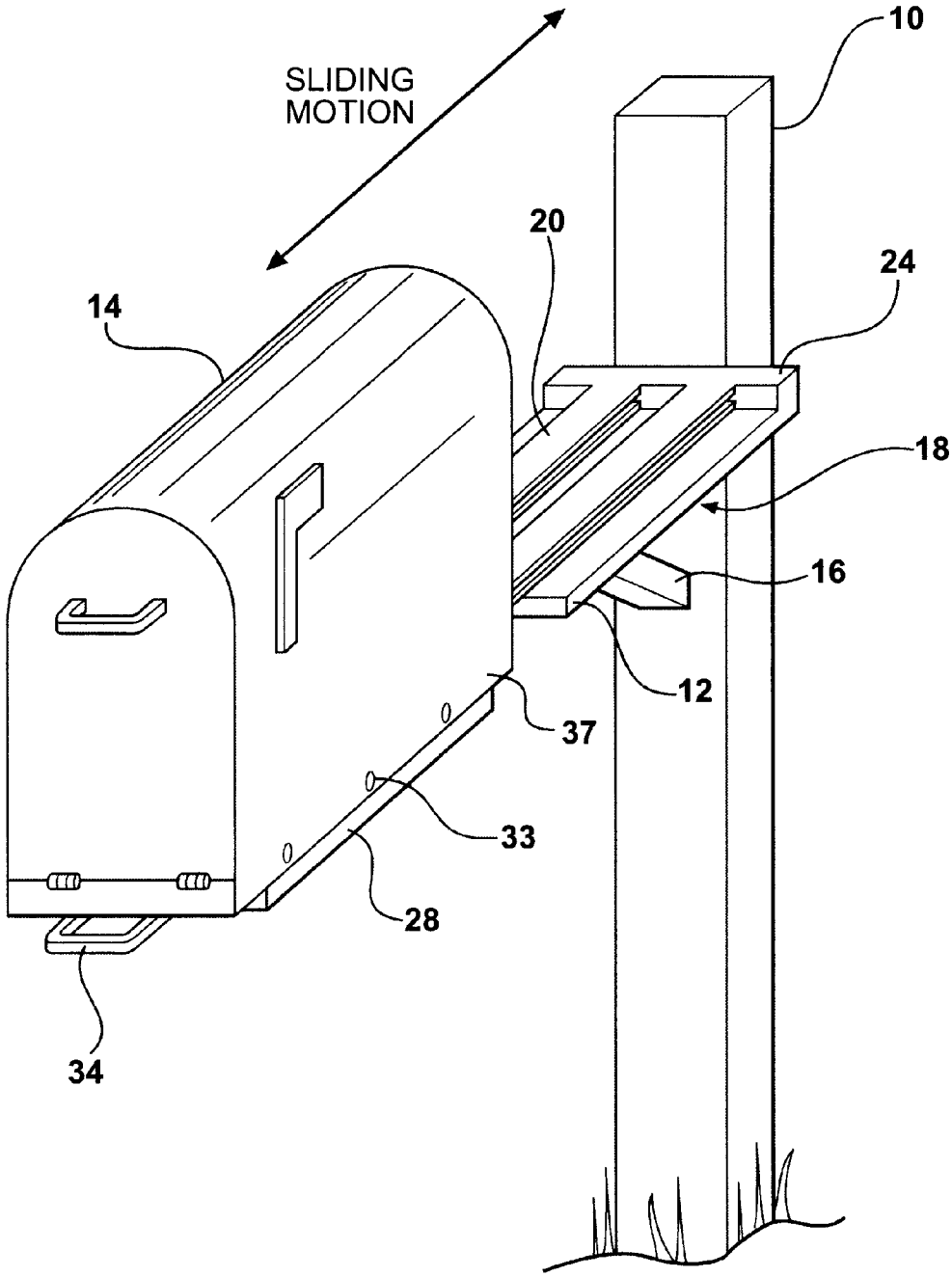
FIG. 1 is a perspective view of an extendible mailbox and mount embodying the invention.
Figure 2:
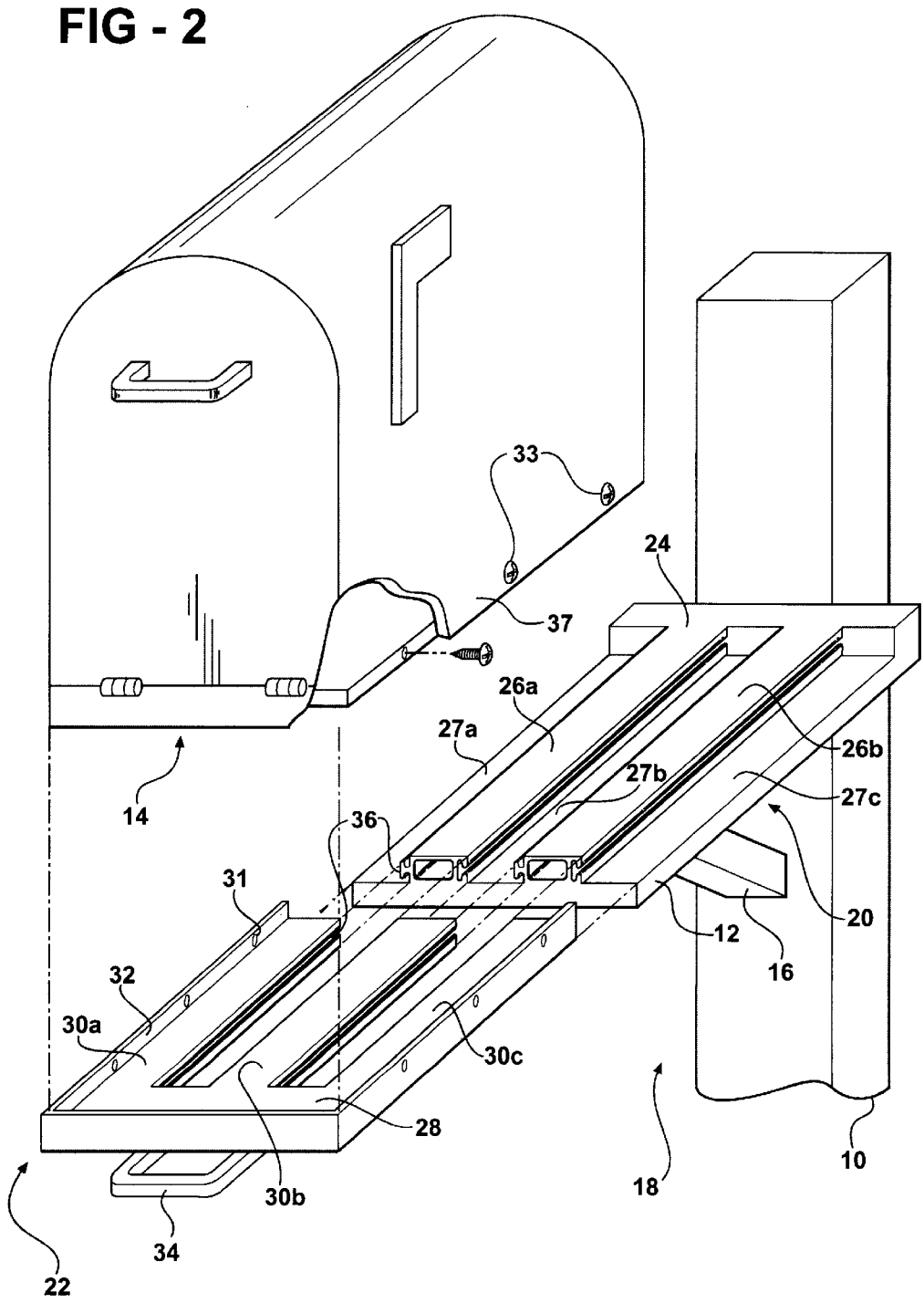
FIG. 2 is an exploded, perspective view of the mailbox and mount of FIG. 1.
Figure 3:
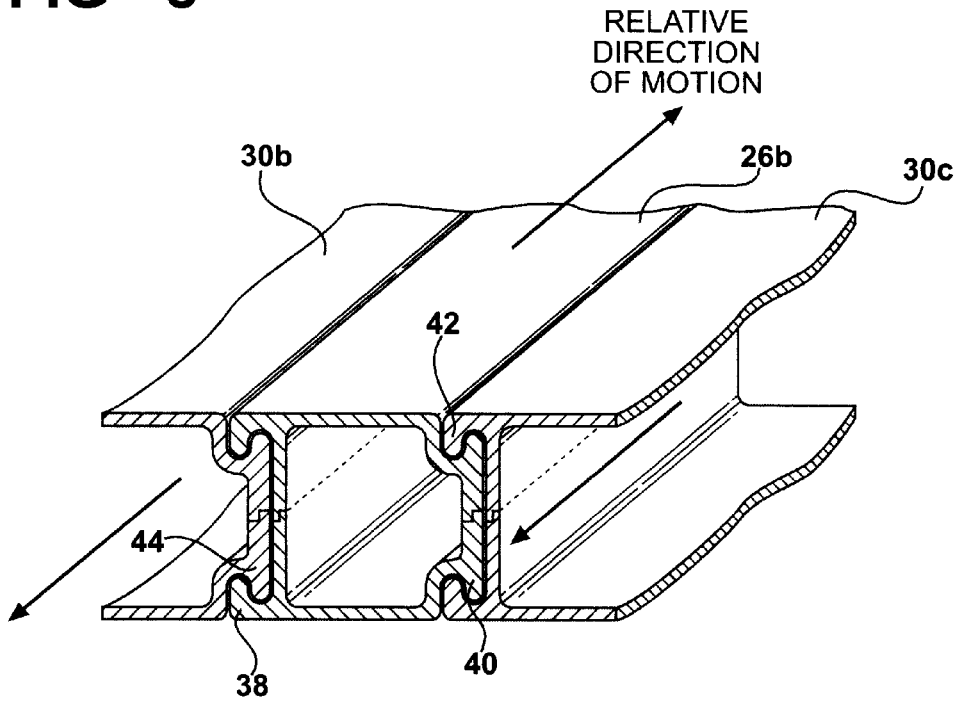
FIG. 3 is an isolated detail view of an illustrative complemental and interlocking slide configuration.

FIGS. 1 and 2 depict a vertical mailbox support post 10 partially buried in the ground adjacent a roadway (not shown). A horizontal platform 12 is fixedly attached to the post to support a conventional rural mailbox 14 of the type having a recessed bottom and a peripheral skirt 37 with screw holes 33 there through. The horizontal platform is supported by a strut 16 (FIG. 1), which is for exemplary purposes only, since the horizontal platform 12 may be supported by the post in other well known ways. A slidable mount 18 is associated with platform 12 and comprises two main sections: a fixed base member 20 and a movable slide member 22. The base member 20 comprises a transverse end section 24 and two parallel, horizontal arms 26*a* and 26*b* defining three slideways 27*a*, 27*b* and 27*c* of which slideways 27*a* and 27*c* are open sided and slideway 27*b* is slot-like. Platform 12 and base member 20 may be made as an integral unit or as separate elements which are later attached. The assembly may be injection molded of various plastics such as ABS, PVC or high density polyethylene.

The movable slide member 22 comprises a transverse section 28 and three parallel slide arms 30*a*, 30*b* and 30*c* which are complemental to the slideways formed by the arms 26*a* and 26*b* of the base member 20 and parallel rectangular slot-like slidways between the arms. When assembled, the slide arms 30*a*, 30*b* and 30*c* and the base slideways 27*a*, 27*b* and 27*c* form an alternating, tongue and groove, coplanar, interlocking assembly in which the arms 30*a* and 30*c* are the outermost elements. A handle 34 is connected to the end section 28 of the slide member 22. A raised outer wall 32 extends around three sides of the slide 22. Preformed into the raised outer wall 32 are screw holes 31 spaced to align with screw holes 33 in the mailbox skirt 37. The slide member 22 and seat 32 are sized so that the mailbox 14 fits over the slide member 22 with the skirt 37 snugly against the side surfaces of the outside slide elements 30*a* and 30*c*. Screws may be inserted through pre-formed holes in the mailbox skirt 37 and into the outside movable slide elements 30*a* and 30*c*.

Looking now to FIGS. 3, 4, 5 and 6, the details of the arms 26*a*, 26*b*, 30*a*, 30*b* and 30*c*, as well as the relationship between them will be explained. Base arm 26*b* shown in FIG. 3 has a female channel configuration 38 on one side and a male slide configuration 40 on the other side. Arms 30*b* and 30*c* have identical female and male configurations 42 and 44 but on opposite sides thereby to create complemental, interfitting tongue and groove slides 36 which permit relative longitudinal movement but prevent the slide 22 from being lifted out of engagement with base 18 other than by sliding motion. Obviously, in the FIG. 2, arrangement arms 30*a* and 30*c* need no interlocking male or female configurations on the outside surfaces thereof.

Figure 4:
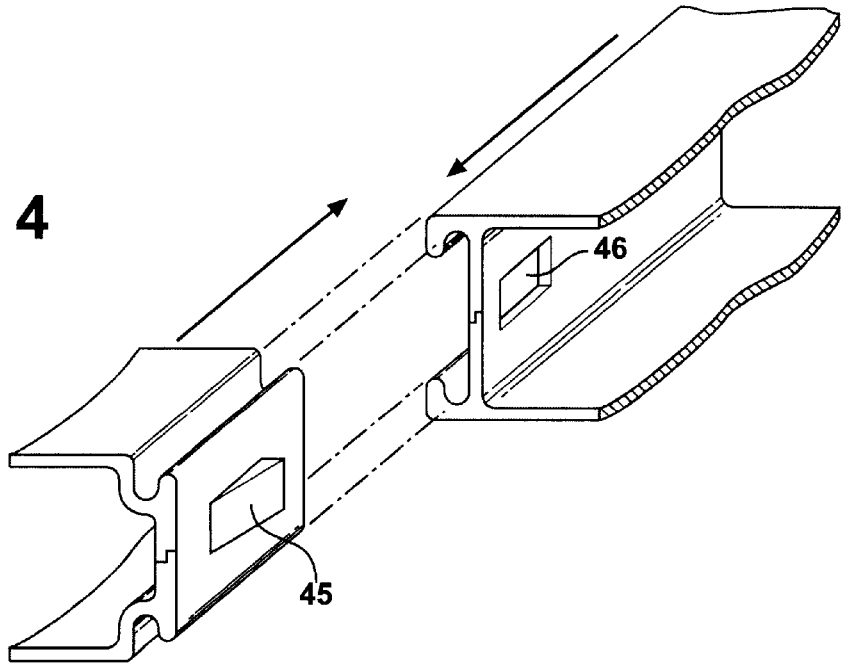
FIG. 4 is a perspective reversed view of the slide member.
Figure 5:
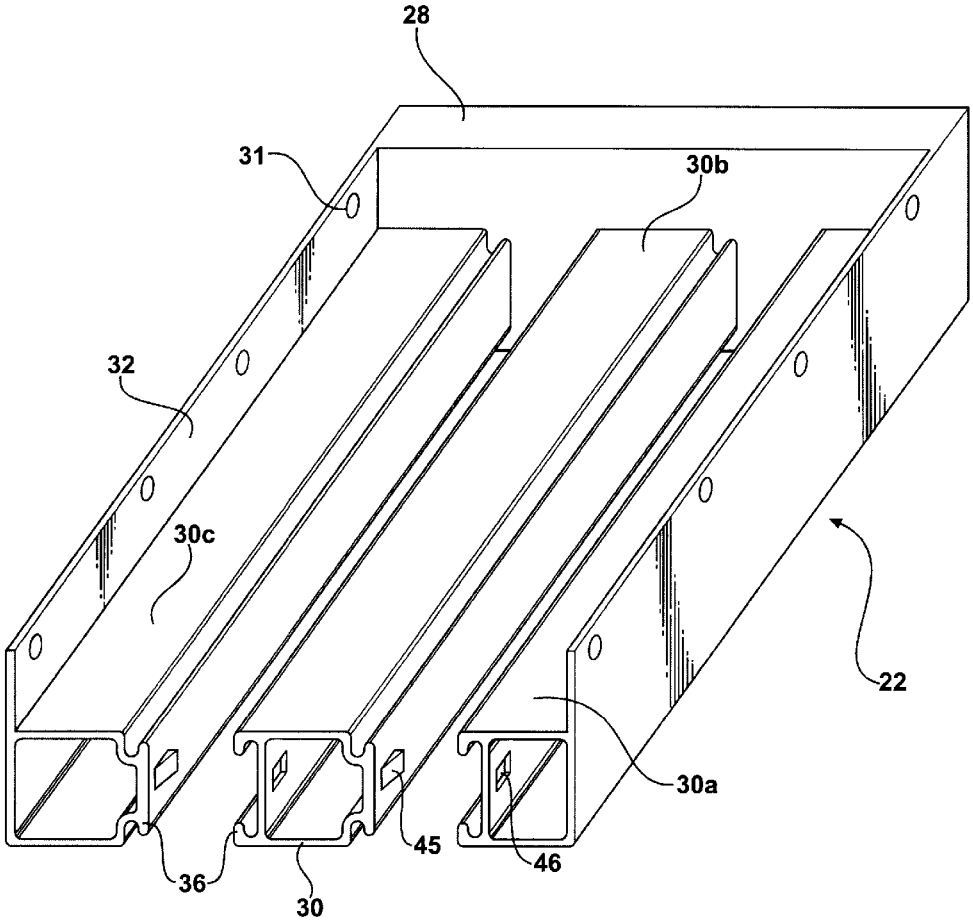
FIG. 5 is an isolated, reversed view of a stop used in the arrangement of FIG. 4.

As shown best in FIGS. 4 and 5, a resilient tab 45 is formed on the male configuration of arms 30*b* and 30*c* near the unjoined ends thereof. The tab is cam or ramp shaped for reasons to be explained. Apertures 46 are formed in the female configurations of arms 30*b* and 30*a* where they will be co-located with the tabs 45 when the slide 22 is assembled to base 20 and fully extended relative thereto. This combination allows the slide 22 to be inserted into the base 20 with the male and female slides fully engaged, the resilient tab 45 folding into a nearly flat condition. If, however, the slide 22 is moved in the extending direction, the tab 45 will reach the aperture 46 and spring into the aperture to form a mechanical stop which prevents further withdrawal.

In the illustrated embodiment of the invention, the post 10, horizontal support 12, strut 16, base member 20, and all of the pertinent elements thereof are made of molded plastic or PVC. The slide member 22 and its pertinent elements are also made of the same molded material. When constructed in this way the slide member 22 and base member 18 are preferably molded in two-piece construction and bonded or welded together to form hollow tubular sections. The various parts are then pre-assembled before being sold to the consumer, such that the consumer can buy a single, unitary product ready to receive a mailbox.

This invention is used in the following manner. The owner buys the post, horizontal support and slidable structure as an assembled product and secures the post into the ground in the usual fashion. The owner then attaches a standard mailbox 14 by slipping the mailbox skirt 37 over the raised outer wall 32 and fastens it to the slide member 22 with screws that fit through the preformed screw holes 31 in the raised outer wall 32. During normal summer conditions when there are no obstructions in front of the mailbox, the mailbox 14 is typically used in the fully retracted position. However, the owner may choose to pull the box toward himself or herself from time to time to accommodate different spacings between the owner's vehicle (not shown) and the box 14. When there are obstructions in front of the mailbox, such as when snow is piled up in front of the mailbox 14 in the winter, the owner extends the mailbox 14 along the tracks to a desired position that gives access to both the owner and also the mail carrier. The owner can leave the box in the extended position until the snow melts, when the box may be returned to its fully retracted position. Alternatively, the owner may leave the mailbox 14 in its fully retracted position at all times except when mail is being deposited or retrieved. In that situation, the mail carrier uses the handle to pull the mailbox away from the post when inserting mail over the snow drifts and then returns the mailbox to its fully retracted position. The user then similarly retrieves the mail by pulling the mailbox into its extended position, removing the mail, and then pushing the box back to its retracted position. By having this flexibility to easily extend and retract the mailbox without having to engage any distinct locking device, the user overcomes the risk of having the mailbox sticking out in traffic and potentially being damaged or hit by passing traffic. Because there are multiple, parallel horizontal slideways or tracks, the mailbox is stable and will not tilt or rotate about a longitudinal axis. No pins, gears or wheels are used and, therefore, there is no need for lubrication of such devices.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

I hereby claim the following invention:

1. A slidable mailbox apparatus comprising:

a mailbox having a peripheral skirt surrounding a recessed bottom panel;

a slide assembly for said mailbox comprising a generally rectangular slide disposed within and adjacent to said skirt, said slide comprising parallel spaced outer members and at least one slot formed between said outer members and defining opposing lateral side surfaces;

a fixed base member having at least one elongate rectangular slide arm having opposite lateral side surfaces adapted to slidingly fit within said slot and cooperate with the lateral side surfaces of the slide;

means on said lateral side surfaces of said slide and base member cooperating to define a tongue and groove locking and sliding relationship between the base member and said slide; and further means on said lateral side surfaces of said slide and base member cooperating to define a resilient stop which permits the slide to be displaced into and relative to said base member but obstructs removal of the slide from said base member;

whereby the mailbox and slide can be slidingly and lockingly disposed on said base member but cannot be removed from said base member beyond full extension thereof without resiliently depressing said stop.

2. A slidable mailbox apparatus as defining in claim 1 further including a handle on said slide.

3. A slidable mailbox apparatus as defined in claim 1 wherein both of said slide and said base member are made of molded plastic.

* * * * *